United States Patent [19]

Rock et al.

[11] 4,143,846

[45] Mar. 13, 1979

[54] ADJUSTABLE BRACKET FOR WALL-UNITS

[75] Inventors: Erich Rock, Hochst; Bernhard Mages, Dornbirn, both of Austria

[73] Assignee: Julius Blum Gesellschaft m.b.H., Hochst, Austria

[21] Appl. No.: 794,229

[22] Filed: May 5, 1977

[30] Foreign Application Priority Data

May 13, 1976 [AT] Austria ..... 3525/76

[51] Int. Cl.[2] ..... F16M 13/00

[52] U.S. Cl. ..... 248/360; 248/222.1; 312/246

[58] Field of Search ..... 248/222.1, 242, 274, 248/288 R, 359, 360, 489, 495; 312/245, 246

[56] References Cited

U.S. PATENT DOCUMENTS

| | | | |
|---|---|---|---|
| 552,550 | 1/1896 | Schaum | 248/17 X |
| 2,035,301 | 3/1936 | Daugherty | 248/274 |
| 2,091,098 | 8/1937 | Hollaender | 248/274 |
| 2,779,464 | 1/1957 | Cairnes et al. | 248/17 UX |
| 2,853,114 | 9/1958 | Barry | 151/69 |

FOREIGN PATENT DOCUMENTS

| | | | |
|---|---|---|---|
| 2038619 | 2/1972 | Fed. Rep. of Germany | 312/245 |
| 2128940 | 1/1973 | Fed. Rep. of Germany | 312/245 |
| 2236397 | 2/1974 | Fed. Rep. of Germany | 312/245 |
| 872061 | 7/1961 | United Kingdom | 312/245 |

*Primary Examiner*—William H. Schultz

*Attorney, Agent, or Firm*—Haseltine, Lake & Waters

[57] ABSTRACT

An adjustable bracket for wall units in which a casing is fastenable to the interior of a piece of furniture. A bracket element is hangable on a wall hook and is held in the casing by an adjusting element. The bracket element is pivotally mounted in the casing, and an adjusting screw is provided with a head having a convex support on a side of the casing. This convex support conforms to a seat for the adjusting screw in the casing. A spacer is mounted in the screw seat in the casing and abuts against a mounting panel. The spacer and the bracket extend through an opening in a rear plane of the casing for concealing the bracket. The piece of furniture is accurately positionable by interaction of the bracket and the spacer so that any change in position of the spacer, results in a change of the angle of the bracket to the wall.

8 Claims, 4 Drawing Figures

ADJUSTABLE BRACKET FOR WALL-UNITS

BACKGROUND OF THE INVENTION

1. Field of the Invention

The invention relates to an adjustable bracket for wall-units which has a casing or the like that can be fastened to the interior of the piece of furniture and a bracket element which is adjustably anchored to the interior and can be hung on the wall hook or the like which is fixed to the mounting panel whereby the bracket element is kept in the casing by an adjusting device, a screw for example.

2. Description of the Prior Art

Bracket fittings of the above-mentioned kind have been frequently used in modern furniture production, especially in the field of kitchen furniture.

It is of particular advantage that they allow a later fine adjustment which means after having mounted the hook in the wall and the fitting in or on the piece of furniture in order to overcome possible tolerances in the brackets.

Whereas a width-adjustment of the fitting is made possible by a relatively wide cross-piece on the hook or on the bracket element of the fitting and a depth-adjustment can be effected by fastening the bracket element by means of suitable tools or a screw or the like especially provided for this purpose, the height-adjustment is frequently carried out by means of an adjusting bolt.

An adjustable bracket for wall-units has been known, provided with a casing in which a screw is fixed in vertical position in respect of the top and lower panel of the wall-unit whereby a shifting element including a support for the hook is mounted on this screw which is mounted in bearings in the portion of its two ends.

It has proved to be of disadvantage that heavy load acts on the screw in the points of support and that, furthermore, a clamping effect occurs between the screw and the shifting element which makes an adjusting of the piece of furniture more difficult.

SUMMARY OF THE INVENTION

It is, therefore, an object of the present invention to produce an adjustable bracket for wall-units which allows at least an adjustment in the height and depth of the piece of furniture and in which occurring forces are diverted as linear as possible. According to the invention this is achieved by the fact that the bracket element is pivotally mounted in the casing on a level in vertical position to the mounting panel whereby the casing hangs on the bracket element in its center of rotation.

Thereby the depth-adjustment will be achieved by a spacer which preferably has the shape of a thread bolt and which is mounted in bearings in the casing and props against the mounting panel in the assembled position.

It has advantageously been provided that the bracket element is constructed as rectangular frame which has on one narrow side a thread for the adjusting screw. In this embodiment the long sides of the frame can be constructed in such a way that they are positioned between the side panels of the casing whereby a separate guide for the bracket element becomes unnecessary.

A further embodiment provides that the frame which forms the bracket element has a double cross-piece on the narrow side which is turned away from the thread for the adjusting screw whereby the bracket element is securely kept in position on the wall hook.

In order to further improve the support on the wall hook a further embodiment provides that the bracket element is angled on the end which is tuned towards the wall hook or the like.

In order to avoid too many turns of the adjusting screw for a height-adjustment over a certain distance on the one hand and in order to facilitate on the other hand the turning of the adjusting screw an embodiment provides that the bracket element is bent towards the mounting panel at an angle of between 30 and 70°. A further embodiment provides that the adjusting screw which is mounted in the bracket element is provided with a stop on the side of the bracket. Thereby an overwinding, which means a turning out of the adjusting screw from the bracket element, is avoided which would cause the wall-unit to fall down.

In order to achieve a particularly favourable adjustability for the angular position of the bracket element and the adjusting screw a further embodiment of the invention provides that the head of the adjusting screw which is mounted in bearings in the casing has a convex support on the side of the casing whereby this convex curvature corresponds to the seat for the adjusting screw in the casing.

It is of advantage if the supporting surface of the adjusting screw is a section of a spherical surface.

BRIEF DESCRIPTION OF THE DRAWING

In the following the invention will be described in detail by means of the attached drawings without being limited to the demonstrated embodiment.

DESCRIPTION OF THE PREFERRED EMBODIMENT

Figure 1:
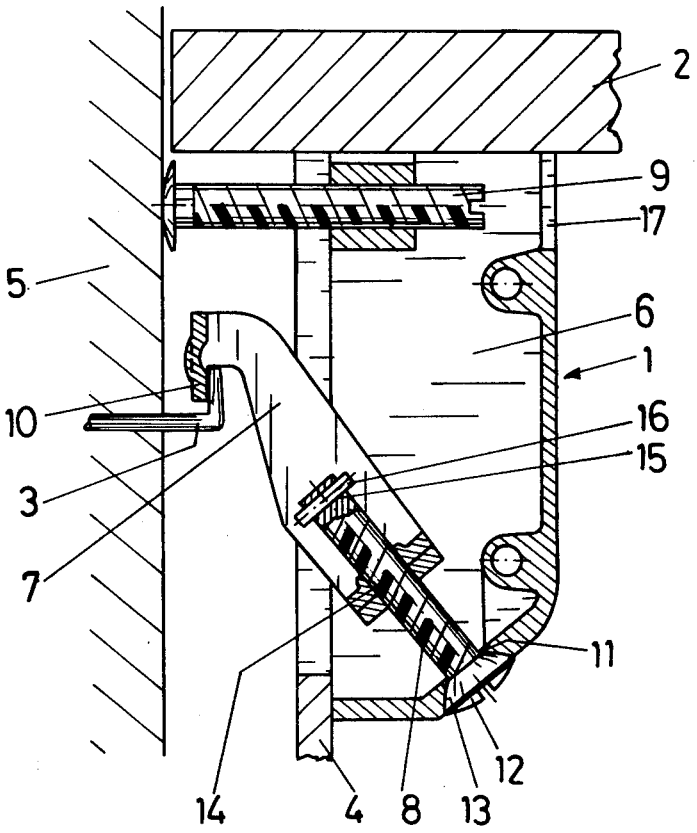
FIG. 1 shows a vertical section of an adjustable bracket for wall-units according to the invention.
Figure 2:
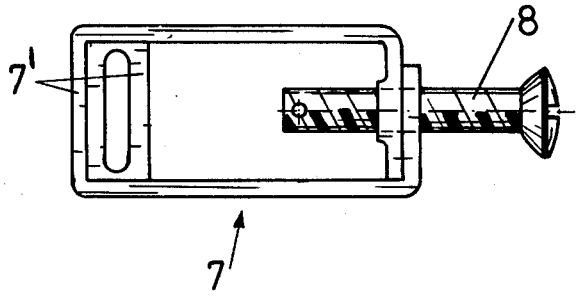
FIG. 2 shows a plan view of an adjustable bracket for wall-units according to the invention.

In the embodiment the piece of furniture is indicated by the top panel 2 and the back panel 4. The piece of furniture is fixed to the wall 5 with the adjustable bracket 1 by means of a wall hook 3.

The adjustable bracket 1 consists of a casing 6 which is preferably made of plastics material, of a bracket element 7 which is therein mounted in bearings, of an adjusting device 8 which is a screw and of a thread bolt 9 which is positioned at the upper end of the casing 6 and which props against the wall 5 and has the function of a spacer.

The bracket element 7 is at its forward end provided with an angle 10 which, according to the embodiment, grips behind the wall hook 3 which is fastened in the wall 5 by means of a dowel for example.

The adjustability in the width of the piece of furniture is achieved by the difference between the width of the wall hook used and the width of the supporting surface of the bracket element 7.

The casing 6 can, for example, be fastened to the side panel of the piece of furniture by means of a dowel pin which can naturally be replaced by screws or the like.

The adjusting screw 8 is inserted through a bore 11 in the casing 6 and its head 12 is mounted in a seat 13 which is formed by the edge of the bore 11.

Figure 3:
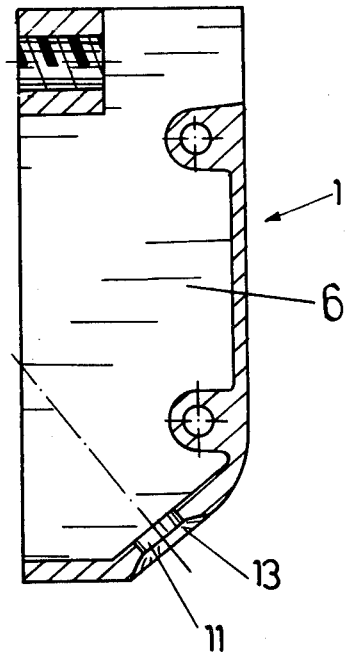
FIG. 3 shows a vertical section of a further embodiment of a casing of an adjustable bracket for wall-units according to the invention and FIG. 4 shows a plan view of an adjusting screw according to the invention.
Figure 4:
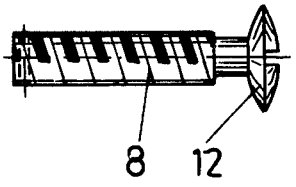

As can particularly be seen in FIGS. 3 and 4 the seat 13 as well as the supporting surface 14 of the head 12 can be curved whereby the curvature is determined by a spherical diameter. Thereby a slight angular adjustment of the adjusting screw 8 and thus of the bracket element connected thereto is achieved over a certain range.

The adjusting screw is directly screwed into a thread 14 of the bracket element 7. In the embodiment the adjusting screw 8 is at that end which is screwed into the bracket element provided with a bore 15 in which a pin 16 is mounted. The pin 16 forms a stop which prevents adjusting screw 8 from being screwed out too far out of the bracket element 7.

The adjustment in the height and depth of the piece of furniture is carried out by more or less turning or screwing out the thread bolt 9 and the adjusting screw 8.

It is of advantage that due to the pivotally mounted bracket element 7 the wall-unit is always pressed to the wall by its own weight.

As can be seen in FIGS. 1 and 3, the casing 6 is provided with an aperture 17 which allows a screwdriver to be inserted into the thread bolt 9.

As can be seen in FIG. 1 the force is transferred in linear direction from the wall hook 3 to the seat 13 for the head of the adjusting screw 12 in the casing 6. Thereby a tilting of the various parts in the adjustable bracket 1 which can be moved towards one another is prevented. FIG. 4 shows an adjustable screw 8 which is tapered in the portion adjacent to the head 12. This embodiment having a casing 6 as illustrated in FIG. 3 allows a further angular adjustment of the adjusting screw 8.

What is claimed is:

1. An adjustable bracket for wall units having a casing fastenable to the interior of a piece of furniture comprising: a bracket element adjustably anchored to an interior of a piece of furniture; a mounting panel; a wall hook fixed to said mounting panel; adjusting means; said bracket element being hangable on said wall hook and being held in said casing by said adjusting means; said bracket element being pivotally mounted in said casing; said bracket element having a center of rotation; said casing hanging on said bracket element at said center of rotation of said bracket element; said casing having screw seat means; said adjusting means comprising an adjusting screw with head in said screw seat means in said casing, said head having a convex support on a side of said casing, said convex support conforming to said screw seat means for said adjusting screw in said casing; a spacer in form of a thread bolt, said spacer being mounted in a second screw seat means in said casing and abutting against said mounting panel, said spacer and said bracket extending through an opening in a rear plane of said casing for concealing the bracket, the piece of furniture being accurately positionable by interaction of the bracket and said spacer so that any change in position of said spacer results in a change of the angle of the bracket to the wall.

2. An adjustable bracket as defined in claim 1 wherein said bracket element comprises a rectangular frame having a thread on one narrow side for the adjusting screw.

3. An adjustable bracket as defined in claim 2 wherein said frame has a double cross-piece on a narrow side turned away from the thread for the adjusting screw.

4. An adjustable bracket as defined in claim 1 wherein said bracket element is angled on an end turned towards said wall hook.

5. An adjustable bracket as defined in claim 1 wherein said bracket element is bent towards said mounting panel at an angle of between 30° and 70°.

6. An adjustable bracket as defined in claim 1 wherein said adjusting screw is mounted in said bracket element and has a stop on the side of the bracket.

7. An adjustable bracket as defined in claim 1 wherein said adjusting screw has a supporting surface comprising part of a spherical surface.

8. An adjustable bracket as defined in claim 1 wherein said bracket element comprises a rectangular frame having a thread on one narrow side for said adjusting screw; said frame having a double cross-piece on a narrow side turned away from the thread for the adjusting screw; said bracket element being angled on an end turned towards said wall hook; said bracket element being bent towards said mounting panel at an angle between 30° and 70°; said adjusting screw being mounted in said bracket element and having a stop on a side of the bracket; said adjusting screw having a supporting surface comprising part of a spherical surface.

* * * * *